US010074296B2

(12) United States Patent
Lyons

(10) Patent No.: US 10,074,296 B2
(45) Date of Patent: Sep. 11, 2018

(54) FLAG FURL PREVENTION DEVICE

(71) Applicant: Charles P. Lyons, Colombia, NJ (US)

(72) Inventor: Charles P. Lyons, Colombia, NJ (US)

( * ) Notice: Subject to any disclaimer, the term of this patent is extended or adjusted under 35 U.S.C. 154(b) by 195 days.

(21) Appl. No.: 15/070,033

(22) Filed: Mar. 15, 2016

(65) Prior Publication Data

US 2017/0270837 A1 Sep. 21, 2017

(51) Int. Cl.
*G09F 17/00* (2006.01)

(52) U.S. Cl.
CPC ..... *G09F 17/00* (2013.01); *G09F 2017/0058* (2013.01)

(58) Field of Classification Search
CPC ..... G09F 17/00; G09F 2017/0008; G09F 2017/005; G09F 2017/0058
USPC ..... 116/173, 174
See application file for complete search history.

(56) References Cited

U.S. PATENT DOCUMENTS 1,195,224 A * 8/1916 Hoffman ..... G09F 17/00 116/174
1,253,380 A * 1/1918 Hoffman ..... G09F 17/00 116/174
2,409,411 A * 10/1946 Zedler ..... E04H 12/32 116/173
2,417,367 A * 3/1947 Leach ..... G09F 17/00 116/175
4,452,167 A 6/1984 Burroughs
4,554,885 A 11/1985 Burny, Jr.
4,603,652 A 8/1986 Blandine
5,237,955 A 8/1993 Jennings
5,255,627 A 10/1993 Williams
5,291,849 A 3/1994 Zeitler
5,402,746 A 4/1995 Deschamps
5,697,321 A 12/1997 Dobbins
5,701,840 A 12/1997 Cross
6,923,141 B1 8/2005 Staats
7,086,346 B1 * 8/2006 Van Horn et al. ..... G09F 17/00 116/173
7,168,389 B2 1/2007 Piedmont
7,707,960 B1 5/2010 Cullop
8,069,811 B2 12/2011 Ciaccia
8,297,216 B1 10/2012 Janton
8,776,714 B1 * 7/2014 Delaney, Jr. ..... G09F 17/00 116/173
8,881,669 B2 11/2014 Horvath
2005/0199176 A1 * 9/2005 Orton et al. ..... G09F 17/00 116/174
2005/0263061 A1 * 12/2005 Llewellyn ..... G01P 5/02 116/174
2006/0207494 A1 * 9/2006 Paley et al. ..... G09F 17/00 116/173

(Continued)

FOREIGN PATENT DOCUMENTS

CN CH 621884 A * 2/1981 ..... G09F 17/00
CN CH 698911 B1 * 12/2009 ..... G09F 17/00

(Continued)

*Primary Examiner* — R. A. Smith
(74) *Attorney, Agent, or Firm* — Baldini Law, LLC; Jack Baldini, Esq.

(57) ABSTRACT

A support assembly for maintaining a flag or banner in a properly displayed manner while mounted on a flag staff, especially when the flag staff is at an angle from vertical, and no matter the wind or other weather conditions.

5 Claims, 7 Drawing Sheets

(56) References Cited

U.S. PATENT DOCUMENTS

| | | | | |
|---|---|---|---|---|
| 2007/0044703 | A1* | 3/2007 | Vickroy | G09F 17/00 116/173 |
| 2017/0110039 | A1* | 4/2017 | Jenkins et al. | G09F 17/00 |

FOREIGN PATENT DOCUMENTS

| | | | | |
|---|---|---|---|---|
| WO | WO 0182277 | A1 * | 11/2001 | G09F 17/00 |
| WO | WO 2006018704 | A1 * | 2/2006 | G09F 7/20 |

* cited by examiner

FLAG FURL PREVENTION DEVICE

FIELD OF THE INVENTION

A support assembly for maintaining a flag or banner in a properly displayed manner while mounted on a flagstaff, especially when the flagstaff is at an angle from vertical, and no matter the wind or other weather conditions.

BACKGROUND

It is a very common practice for people to display flags or banners from their homes. Typically, a homeowner desiring to display a flag simply goes to a store that sells flags and flagstaffs and purchases a flagstaff that is typically mounted to the side of a house or a post on a porch that is typically mounted on an angle and the flag then is attached to the angled flagstaff.

Common flags sold in this manner are sized at 2'×3'; 2.5'×4'; 3'×5'; and 4'×6'; with the 3'×5' size being the most common. Government Specification U.S. flags should be sized in a 1:1.9 hoist to fly ratio (the 3'×5' flag size is a 1:1.67 hoist to fly ratio, i.e., a bit smaller in ratio from the length from the flagstaff to horizontal measurement than an 'official' U.S. flag). The longer the flag to its height, and the greater the angle from vertical the mount, the more likely a wind event is to cause the flag to wrap around the flag pole in a manner that the flag gets stuck and does not unwrap on its own.

It is a well known in the flag flying art that when flags are displayed on fully vertical poles, i.e., free standing flagstaffs not attached to a building or otherwise mounted on a flat roof in a completely vertical orientation, there is very little wrapping of the flag around the flagstaff, and even when there is some wrapping, the flag freely falls and unwraps itself. It is when the flagstaff is mounted at an angle, as it typically is when mounted to the side of a house or a house or porch post, and all the way to a fully horizontal mount, i.e., 90 degrees to the fully vertical orientation, that flag wrapping around the flagstaff, called furling, becomes a major problem. Firstly, the furling issue is heightened as to happening in the first instance as a result of the hanging angle of the flag; and, when it occurs, the flag does not unfurl itself, i.e., when the wind ceases, the flag remains wrapped around the flag pole. For example, see U.S. Pat. No. 4,452,167 describing the furling problem and as being particularly acute where the flagstaff is at a 45 degree angle with the vertical.

There have been many attempts to solve the flag furling problem. For example, the patent just noted above, U.S. Pat. No. 4,452,167, entitled FLAG MOUNTING DEVICE, provides "a device for preventing a flag from wrapping around a flagpole, especially one which is inclined at an angle with the vertical. The flag is mounted along one edge to a support member which in turn is pivotally mounted for rotation about the flagpole. A semi-flexible rod is sewn into the hem along a lower edge of the flag. This semi-flexible rod is pivotally attached to the support member such that it can pivot from a position perpendicular to the support member to a position essentially parallel with the support member. Thus, the flag can be stored by folding the semi-flexible rod parallel with the support member and the material of the flag wrapped around the support member and/or the flagpole. When not in storage, the semi-flexible rod extends the lower portion of the flag outward from the flagpole effectively preventing the flag from wrapping back around the flagpole and becoming entangled.

In another example, U.S. Pat. No. 5,255,627, entitled FLAG AND FLAGPOLE ATTACHMENT, discloses "an attachment device for mounting on a flagpole and for releasable attachment to an edge portion of a flag from entanglement with adjacent structures and also from wrapping around the flagpole. The attachment device includes a pole mounting bracket adapted for receipt on a portion of the flagpole. A control arm is pivotally mounted in a holder disposed in the pole mounting bracket and is capable of extending outwardly therefrom positioned along and parallel to an edge portion of the flag. A removable clip is used for attaching the edge portion of the flag to the control arm, thereby allowing the opposed edge of the flag to flow freely. The control arm is positioned with respect to the pole mounting bracket in a manner which allows it to pivot around the pole in a range of less than 360 degrees, thereby preventing the flag from wrapping around the pole of from becoming entangled in adjacent structure."

In another example, U.S. Pat. No. 5,697,321, entitled FLAG-BANNER SUPPORT ASSEMBLY, discloses "a flag or banner assembly wherein a flag or banner hangs from a generally horizontal staff and wherein an arm or rod extends downward from the staff and attaches to a lower region of the flag or banner wherein wrapping of the flag or banner around the staff is substantially reduced or prevented.

In another example, U.S. Pat. No. 7,707,960, entitled FLAG RESTRAINT, discloses "an apparatus for the prevention of flag entanglement upon a flagstaff that is comprised of a specifically milled wood block which acts as an attaching mechanism to the flagstaff and is the hinge point for a metal rod that is attached to the flag. The hinge point of the block allows the rod to swing in a 180 degree arc from the 90 degrees to the 270 degrees. The length of the rod being equal to or greater that the width of the flag in conjunction with the hinge block action prevents the flag from flipping over and tangling on the staff."

In another example, U.S. Pat. No. 8,881,669, entitled WRAP PREVENTING FLAG APPARATUS, discloses "a wrap preventing flag apparatus including a rod extending from the upper portion of a flagpole in a gravity plane with an attachment securing the top edge of a flag to the rod. A rod support inter-connects the rod and the upper portion of the flagpole for preventing the rod from rotating about the pole axis while allowing free rotation of the rod under the force of gravity only in the gravity plane. The rod support includes a pair of stops for limiting the rotation of the rod in or parallel to the gravity plane. In the first embodiment, the rod support extends into an especially fabricated flagpole whereas the rod support of the second embodiment includes a first bracket which is disposed about an existing flagpole for securing the rod support to the flagpole.

The flag support and furl prevention devices provided in the foregoing examples are complicated, all requiring some sort of rotational movement of the flagstaff or portion thereof or pivotal movement of a securing arm. There is generally a complicated connection between the mounting bracket to the flag pole and the support arm itself. For example, U.S. Pat. No. 4,452,167 requires a semi-flexible rod sewn into a hem of the flag allowing for the secured edge to flex or pivot. U.S. Pat. No. 5,255,627 teaches up to 360 degree rotation around the flagstaff. U.S. Pat. No. 7,707,960 teaches up to 180 degree rotation. U.S. Pat. No. 5,697,321 employs two interconnected eye hooks to attach the support rod to the flagstaff mounting ring that allow an undisclosed amount of movement, ostensibly dependent upon the size of the eye hooks, which is undisclosed in the Specification. Moreover, in this 'eye hook' scenario, the flag itself is attached to the flagstaff using similar type eye hooks allowing movement. This configuration will produce an unnecessary amount of stress on the flag material in windy conditions and will not prevent an unsupported portion of the flag from folding and getting pinched within the mechanism. Moreover, eye hooks are prone to becoming unhooked with excessive manipulation. U.S. Pat. No. 8,881,669 recognizes the need to prevent rotation around the flagstaff axis, but nevertheless teaches that free rotation in the gravity plane is desirable. And, this patent teaches that the support rod attaches to the top edge of the flag. In this embodiment, in windy and wet conditions, if the flag rotates downward in the gravity plane, the flag will still be able to wrap around the pole axis and get tangled.

Thus, none of the disclosed references, or any other of the many duplicative references found, disclose a simple one-piece construction device, simple to install and simple in design, that is static once mounted (actually teaching away from all of the noted references), that results in an inexpensive device that is effective in preventing flag furl in any weather conditions. It will be appreciated by one of skill in the art, that this disclosure teaches a one-piece, simple support rod, that does not allow any rotation whatsoever, extending only so far as is necessary based on the size of the flag along the bottom edge, with a simple attachment mechanism for use with any existing flagstaff and flag.

This disclosure teaches that rotation is not only not necessary, it is in fact, undesirable, i.e., all of the foregoing references and those not referenced but that are merely duplicative, teach away from the instant disclosure. Moreover, the simple design here encompasses an easy to employ one piece design whereby the support rod has a mounting ring component, sized to just slide over an existing flagstaff (with different sizes contemplated for various size flagstaffs and various flag dimensions) and is secured into place to prevent any movement once installed. Then, the support rod itself, its length chosen within a specific range based on the dimensions of the flag as described below (but not the entire length of the flag thereby allowing the flag to hang naturally along at least a portion of its length), is attached to the bottom edge of the flag as described in one of the many embodiments below. Once attached as described, a triangular portion of the flag (the triangle formed by the line of the attachment edge of the flag to the flagstaff, the line of the attached bottom edge of the flag to the support rod and the imaginary line that joins the preceding two lines and completing the triangle) remains taut and displayed. The remaining portion of the flag hangs freely, but in any windy or wet conditions, is incapable of reaching around itself to get tangled or wrapped around itself, the flagstaff or any adjacent structure.

Thus, all of the disclosed references provide devices that are complicated, expensive, introduce extra components, rotate or pivot somehow and do not actually accomplish all that is intended, and/or create additional stress that will prematurely ruin the flag. Therefore, there exists a need to provide a flag furl prevention device that is simple, simple to install, reliable, inexpensive, and does not have any adverse effect on the flag itself.

This disclosure teaches solutions to the problem of flag furl and in one embodiment, provides a one-piece, simple, simple to deploy, inexpensive, support arm that is immoveable once deployed. It is to be appreciated that this disclosure teaches a device that, simply by manufacturing its size according to the dimensions of the flag and flagstaff, is capable of implementing with any existing correspondingly sized flag and flagstaff. No other special limitations need be implemented.

SUMMARY

In general, this disclosure provides a flag furl prevention device to be used with existing flags and flagstaffs. By simply installing a device as taught herein, no other additional flags, flagstaffs or specially manufactured components are required.

One skilled in the art will appreciate that the device taught in this disclosure can be applied very easily to any flag and flagstaff by simply manufacturing with an appropriately sized mounting ring component, based on the size of the diameter of the flagstaff, and appropriately sized length of support rod component based on the dimensions of the flag. For sake of clarity and no limitation should be read as a result, the description of the drawings and detailed description below will be made with reference to application to a commonly used flag and flagstaff, namely a 3'×5' flag and standard home mounting angled flagstaff with a standard 1" diameter. One of skill in the art will appreciate that the dimensions can be easily adjusted without any undue experimentation according to the physics described below and in the drawings to accomplish the same end result with any sized flag and flagstaff. For example, if a 2" diameter flagstaff is utilized, the corresponding mounting ring component would need to be similarly larger. Or, if the flag was a 4'×6' flag, the support rod would need to be similarly longer as described by the geometry and physics below. The mounting ring diameter is based upon the flagstaff diameter (it could even be square or octagonal or adapted to any cross-sectional shape) and the support rod length is determined by the dimensions of the flag to be displayed.

The following specific definitions are for terms as used throughout this specification:

"Flag" means any flag, pennant, banner or the like, that is typically mounted and displayed on a pole.

"Flagstaff" means any suitable pole or mounting rod to which a flag is typically mounted and displayed from and may encompass a freestanding such pole or a pole that is mounted to some other structure.

"Mounting Ring" means that component of a device as described herein that is used to fasten said device to a flagstaff.

"Support Rod" means that component of a device as described herein that is used to secure a portion of one edge of a flag.

It should be noted that while a mounting ring and a support rod are described as separate components of a device as described herein (and their dimensions dependent upon separate things), nothing should be construed as limiting that such components cannot be manufactured as a one-piece construction (much as a standard wrench manufactured as one-piece nevertheless has a component that fits the bolt and a component that is the handle to be held and to deliver torque during use).

BRIEF DESCRIPTION OF THE DRAWINGS

The accompanying drawings, which are incorporated herein and form part of the specification, illustrate various embodiments as disclosed herein and, together with the description, further serve to explain the principles and limitations of this disclosure and will enable a person of ordinary skill in the art to make and use embodiments as described herein. Throughout all of the drawings, like reference numbers indicate identical or functionally equivalent elements. A more complete appreciation of embodiments taught herein and many of the attendant advantages thereof will be readily obtained as the same becomes better understood by reference to the following detailed description when considered in connection with the accompanying drawings, wherein.

DETAILED DESCRIPTION

Figure 1:
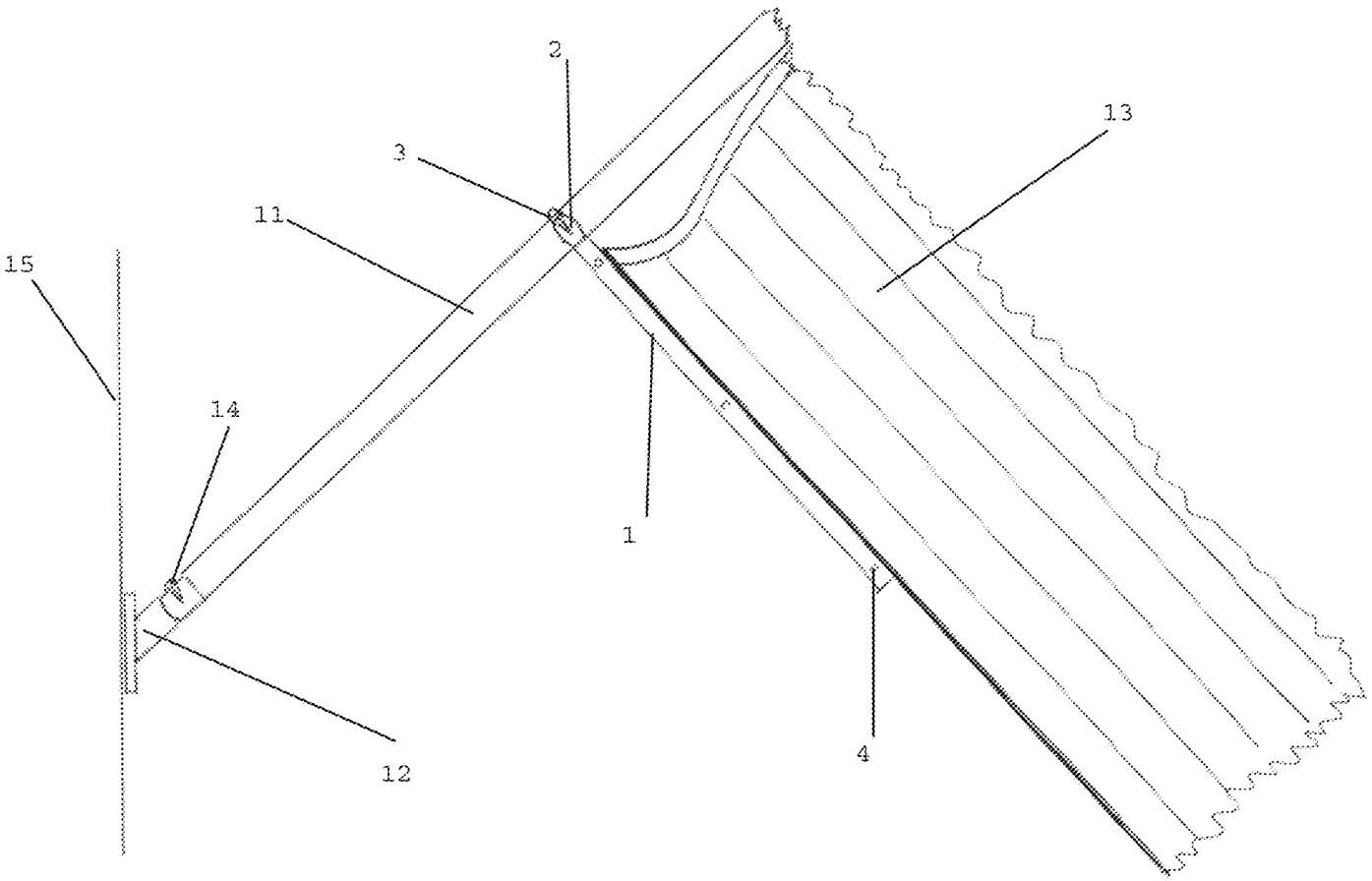
FIG. 1 depicts a typical flag (13) mounted to a flagstaff (11) that is mounted to the side of a house (15) that has attached to it a mounting bracket (12). In this embodiment, a support rod (1) is attached to the bottom edge of a flag (13) and is further attached to a flagstaff (11) by way of a mounting ring (2) and secured from rotating about the flagstaff via a securing screw (3). The entire flagstaff (11) is secured from rotating in the mounting bracket (12) by way of a separate securing screw (14).
Figure 2:
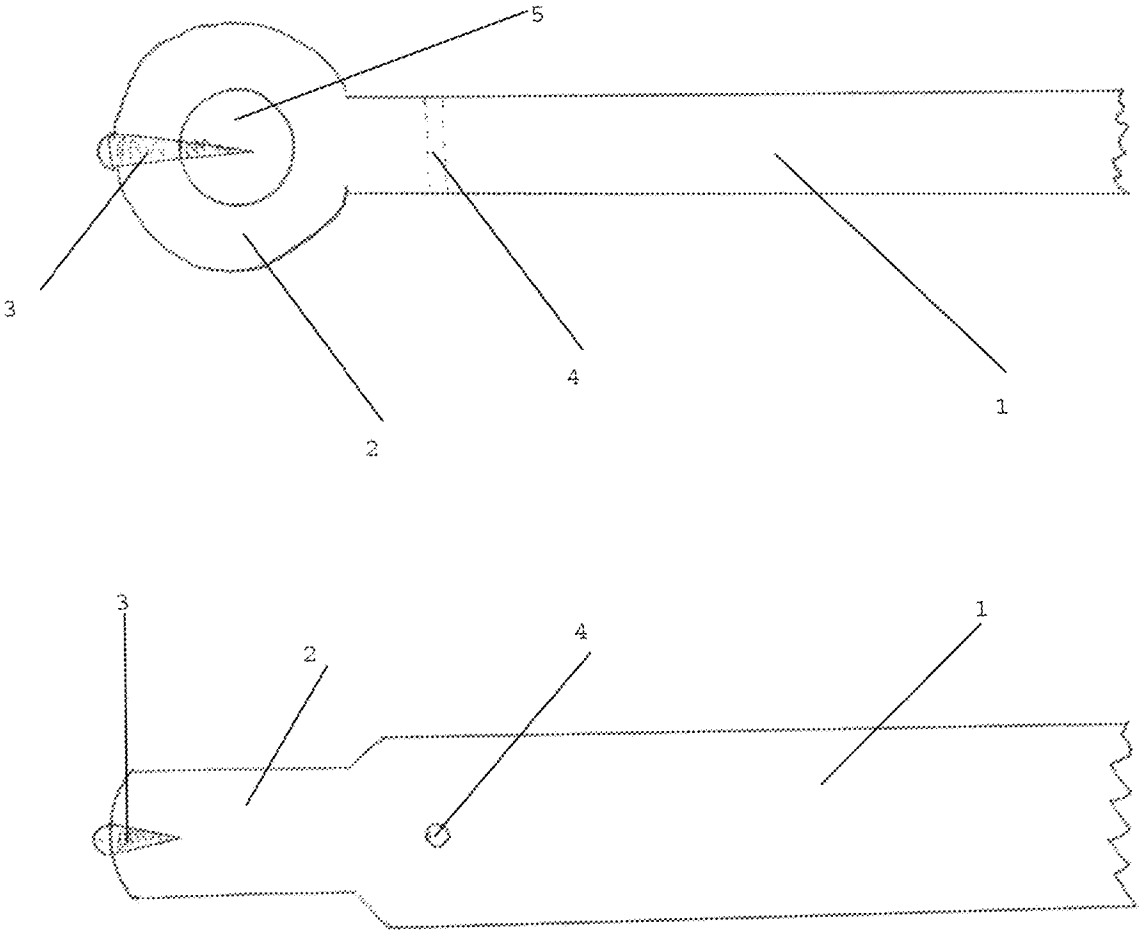
FIG. 2 depicts two views of one embodiment of a device as taught herein wherein a support rod (1) is manufactured with an attached mounting ring (2). The device further comprises a through hole (4) to facilitate attachment to a flag (not shown) and the mounting ring comprises an inner circumference (5) to slip over a flagstaff (not shown) and a securing screw (3) is fitted through the mounting ring (2) and into a flagstaff when present.

For clarity of disclosure, and not by way of limitation, the following detailed description is divided into the following subsections that describe or illustrate certain features, embodiments or applications of the present invention.

The Flagstaff Mounting Ring

It will be appreciated by one skilled in the art that flagstaff mounting ring will have an inside diameter to match the outside diameter of the flagstaff such that when slid into position, there will be a snug fit without wobble. Typically, a one inch diameter flagstaff mounting bracket is utilized with a flagstaff that has an outside diameter of 15/16 of an inch. In this case, the inside diameter of the mounting ring should be 15/16 of an inch or somewhere very slightly larger, such as 31/32 of an inch. In the case of a 2" flagstaff, the mounting ring would desirably be 2 and 1/32 of an inch, i.e., always just slightly larger and the same shape as the flagstaff so that it can slide over it with minimal movement or play and once in proper position, capable of being secured in place so that there is no movement.

In one embodiment of the present invention, the flagstaff mounting ring will be of sufficient thickness chosen based on the material implemented such that it will not split or break under the force of wind creating a torque or a pulling away from the flagstaff. Where constructed of cast aluminum, a one quarter inch thickness is sufficient.

Other non-limiting examples of suitable materials for construction of the device under embodiments as described herein include, stainless steel, aluminum, plastic, acrylic, wood, synthetic resin, synthetic wood, fiberglass and other synthetic materials. The ideal material will be chosen based on its strength, ease of manufacture, cost, weight, aesthetics and durability.

The flagstaff mounting ring will also contain a bore hole at its back end (the end opposite the support rod extension) to accommodate a set screw wherein, one the device is mounted over the flagstaff and put into the appropriate position, a set screw of sufficient length (typically a one inch screw will suffice) is screwed through the bore hole and into the flagstaff to prevent the device from either: (a) rotating around the flagstaff; (b) moving up or down the flagstaff; or (c) pivoting or exhibiting any free play in relation to the flagstaff.

The Support Rod

It will be appreciated by one skilled in the art that the support rod shall be constructed as a one piece extension extending out from the mounting ring for the purpose of securing a portion of the bottom edge of the flag. On a flag that is 3'×5', or 2,160 square inches, the desired length of the support rod is about 20 inches.

One of the objects taught in this disclosure is to have a flag that flies as freely as possible with a natural hang. However, when left to hang completely free, in windy conditions it is known that the flag that is flown on a 45 degree angle is prone to wrapping around the flagstaff and not returning to a free flying condition on its own. If the entire bottom edge were secured to a support rod in the manner indicated here, it is obvious that the flag would not be free to wrap around itself or the flag pole. However, in that condition, the flag would not appear to hang freely at all. Instead, it would appear as if the flag were in a constant state of extension—it would not be 'flying'. On the other hand, if the support rod were only one half an inch in length, it is obvious that that would be like having no support rod at all. Although the flag would fly freely, nothing would prevent wrapping. What is to be determined, and what is an embodiment taught herein, is if there is an optimal length of a support rod that is long enough to prevent flag furling in windy or any adverse weather conditions, and yet short enough so that the remaining unsupported length of flag is enough for the flag to appear to fly completely free.

As noted below, in a 3'×5' flag, where there is a 1:1.67 ratio, the desired support rod length is approximately 20 inches, or ⅓ the length of the bottom edge of the flag. Where a U.S. official flag of a 1:1.9 ratio is flown, i.e., longer in distance from the flagstaff than as a ratio to the height of the flag, a correspondingly longer support rod would be desired, or approximately 23 inches (assuming a 3' height in a 1:1.9 ratio). The section below describes the geometry of why these numbers work.

Figure 5:
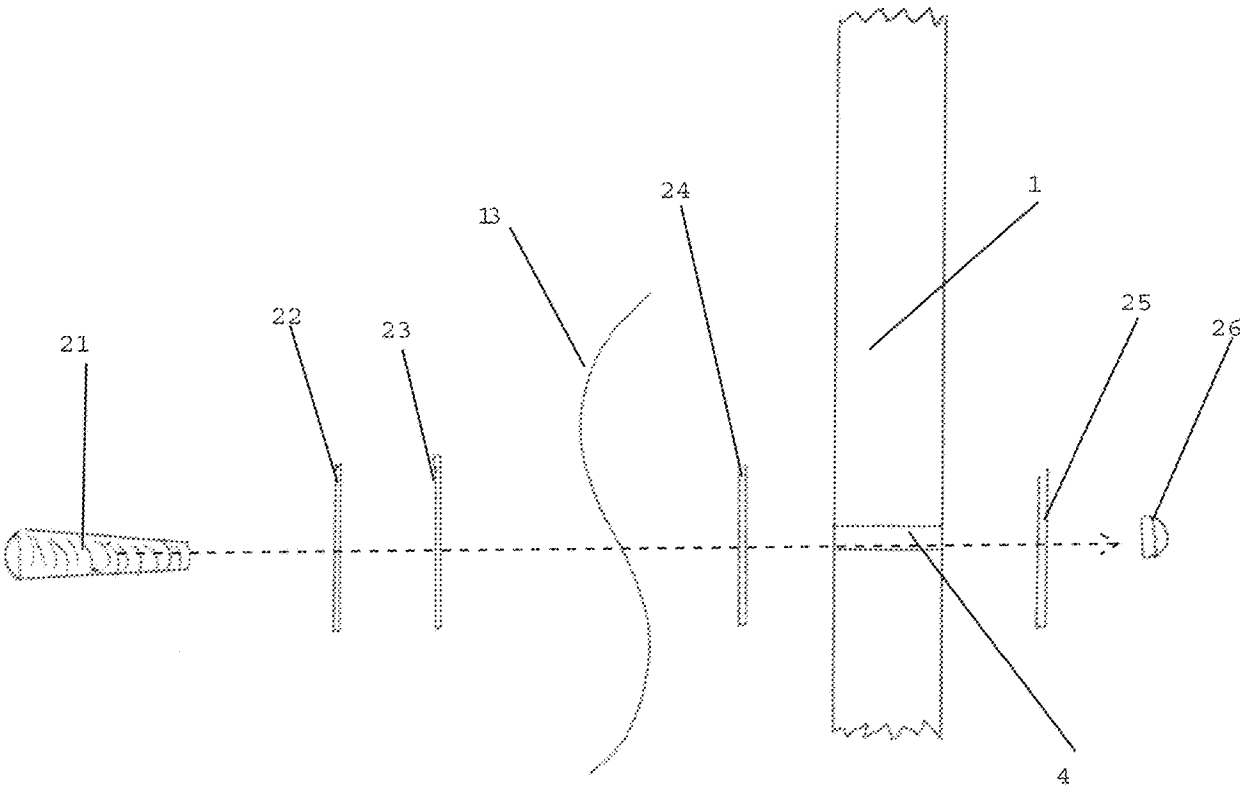
FIG. 5 depicts one embodiment of a device as taught herein demonstrating one possible configuration of securing elements to secure the bottom edge of a flag (13) to a support rod (1) by affixing the securing elements through a through hole of the support rod (4). As depicted here, there is a one inch bolt (21), a washer (22) a rubber grommet (23), a second rubber grommet (24), a second washer (25) and a nut (26).

The support rod shall be further constructed in a manner to easily secure the bottom edge of a flag to it. In one embodiment, this may be accomplished with bore holes through the support rod at equal distances along its length, typically at 3", 10" and 17" on a twenty inch support rod. Referring to FIG. 5, through each bore hole is fitted a one inch bolt secured on the other side by a corresponding nut. In between is sandwiched two washers and two rubber grommets, the rubber grommets sandwiching the flag itself to protect the flag, and the washers to prevent the nut and bolt from unscrewing.

Figure 3:
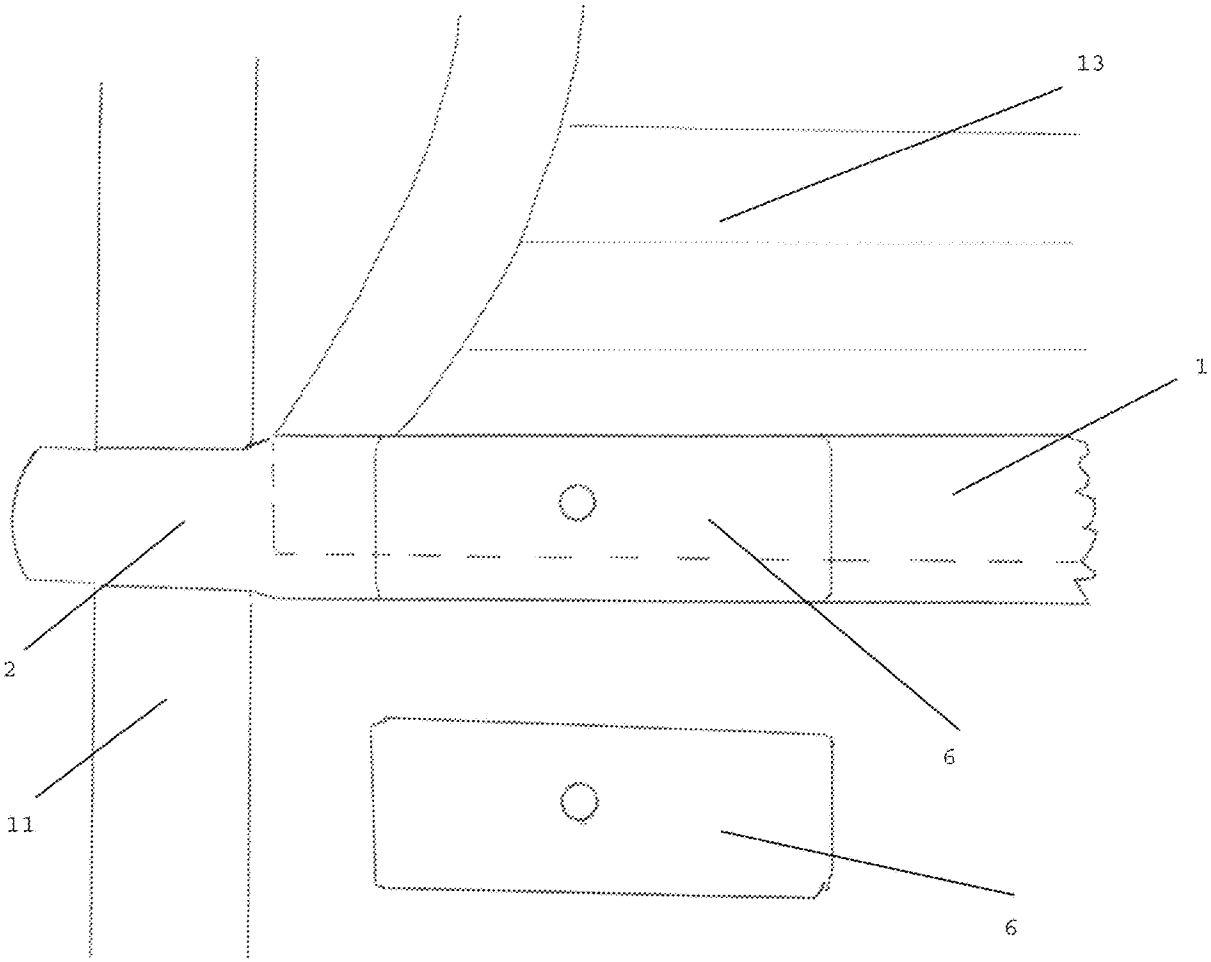
FIG. 3 depicts one embodiment of a device as taught herein whereby a separate bracket (6) is fitted to slip over a support rod (1) to assist in securing the bottom edge of a flag (13) against the support rod (1).
Figure 4:
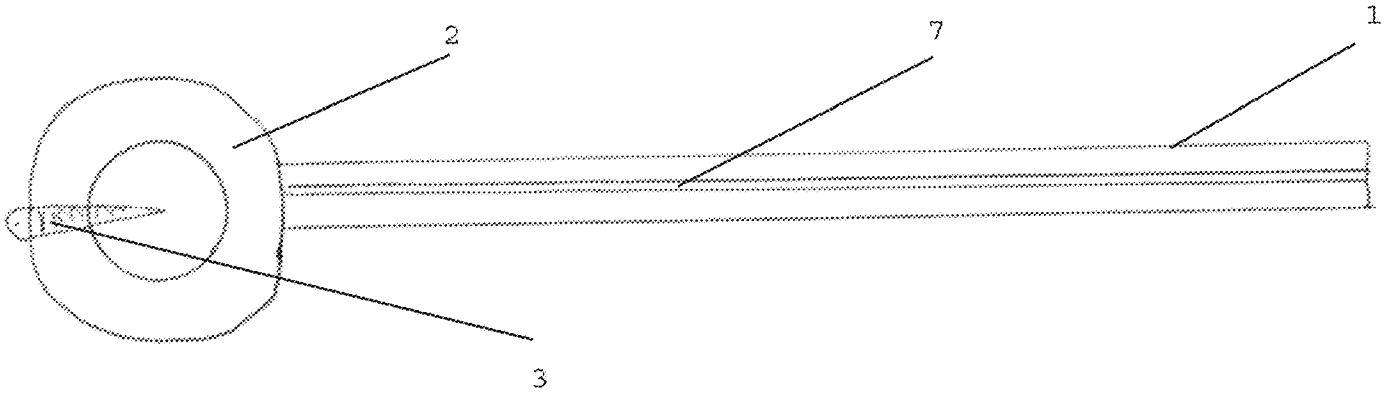
FIG. 4 depicts one embodiment of a device as taught herein with a top view exposing a channel (7) that is routed out of the support rod (1) into which a flag (not shown) can have its bottom edge fit to assist in securing to the support rod (1).
Figure 6:
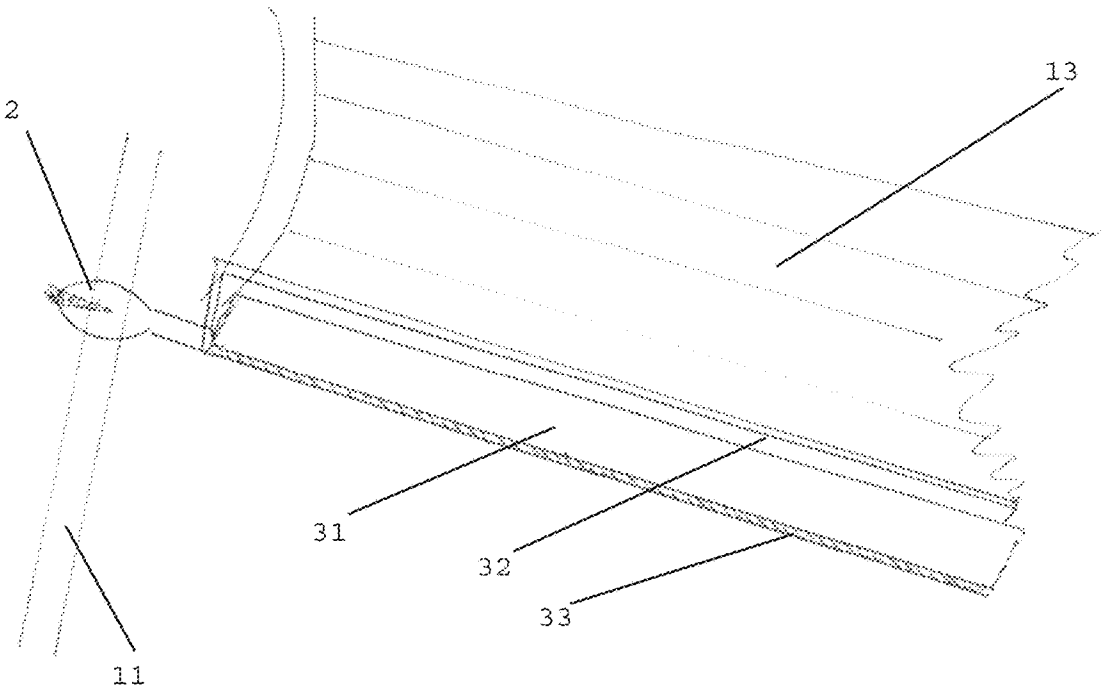
FIG. 6 depicts one embodiment of a device as taught herein with an alternate manner for the support rod to be constructed to secure the bottom edge of a flag (13) with a clamping mechanism. In this embodiment, there are two edges of a support rod (31) and (32) that are attached with a spring mechanism (33) such that the two edges may be opened, the bottom edge of the flag inserted and when let go, the edges clamp shut securing the flag.

In other embodiments, the flag may be secured via alternate methods. For example, and without limitation, referring to FIG. 6, in one embodiment, the support rod itself may be constructed such that it acts like a clamp, spring loaded, whereby the two sides of the support rod can be forced open, the flag inserted and allow the spring to clamp the flag inside in the closed position. Alternatively, referring to FIG. 3, there may be used slide on clamping clips that slide on over the support rod, securing the flag to the support rod at various positions along the length. These slide on clamps may be used with or without the bore hole through bolts and nuts as described above. It will be appreciated by one of skill in the art that there are myriad ways of securing the bottom edge of the flag to the support rod, including but not limited to snaps, hook and loop fastener, magnets, and the like and that in some embodiments, the flag itself may be modified (such as with a hemmed pocket into which the support rod may be fitted) to adapt with and connect to the support rod. This patent disclosure should be read to include any known methods of securing a fabric or any flag or banner material to a solid support rod.

It is envisioned that in one embodiment, the support rod as just described and the mounting ring as described above are constructed from one solid material to ensure the most desirable strength, aesthetics, ease of use and implementation and cost effectiveness. However, it should be noted that it is appreciated that the two components could be easily manufactured separately and fastened together at any stage with known methods of fastening. For example, and without limitation, the mounting ring and the support rod could be manufactured to comprise a mating mechanism such as typical wood furniture joints or the neck and body of a guitar and once fitted together, secured with screws, clamps, nuts and bolts and other well known securing mechanisms.

Geometry of Flag Dimensions and Furling Tendency

Figure 7:
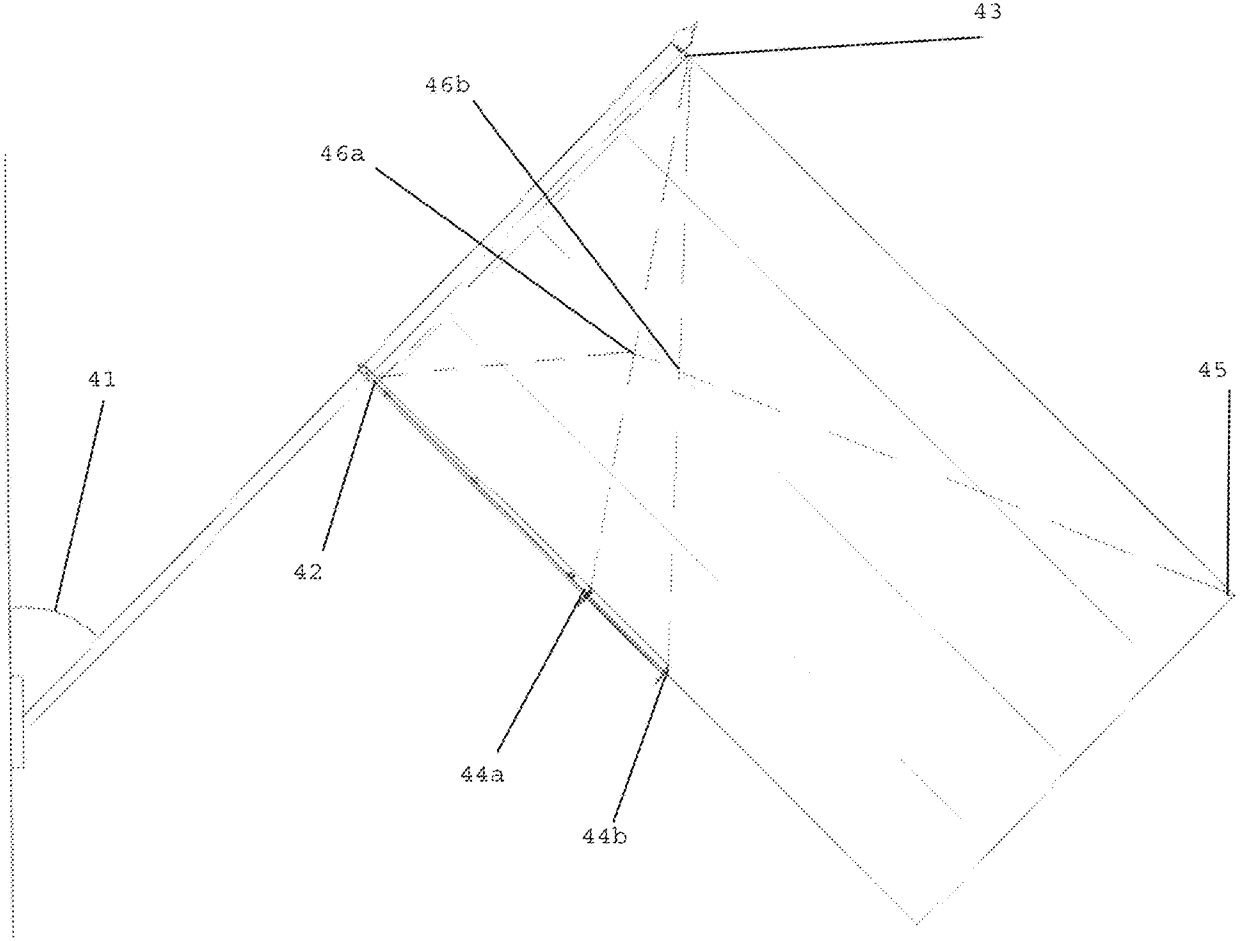
FIG. 7 depicts embodiments of the geometry and physics of the implementation of a device as taught herein. Specifically, there is an angle (41) formed by the perpendicular surface to which the flagstaff mounting bracket is attached and the flagstaff. Further, there is an attachment point (42) where the bottom edge of the flag is secured to the flagstaff and a second attachment point (43) where the top edge of the flag is secured to the flagstaff and a third attachment point (44) where a portion of the bottom edge of the flag is attached to the end of a support rod. Note that the support rod may be of any length, with two potential lengths depicted here, namely (44*a*) and (44*b*). The geometry and physics as described below will inform one of skill in the art the actual desired length based upon the dimensions of the flag.

Referring to FIG. 7, there are several important points, namely, the points designated by reference numbers (42), (43), (44*a*), (44*b*), (45) and (46*a*) and (46*b*). The length of the support rod defines the point at (44), with the "a" and "b" simply denoting alternative lengths. A flag with a surface area is defined by its length and width, its length measured as the distance between points (43) and (45) and its width measured as the distance between points (42) and (43). This disclosure teaches that it is only necessary to support a portion of the total surface area of the flag defined by the triangle formed by points (42), (43) and (44) in order to prevent furling of the flag, i.e., the wrapping of the unsupported edge of the flag around the flagstaff. One of skill in the art will appreciate that with no support, the flag can pivot at points (42) and (43) and have the entire length of the flag to wrap around itself. When at an angle (defined by the angle at (41)), the downward force of gravity, and the non-vertical position of the flagstaff, will keep the flag wrapped around the flagstaff once wrapped in the first instance.

By having no support along the top edge of the flag, from that point, the flag material will tend to droop vertically downward in the absence of any wind. So long as the support rod does not extend outward enough such that the point at (44) does not occur at the point beyond where the imaginary line formed from the point at (43) extending downward in an exact vertical to the ground intersects the bottom edge of the flag would be pulled taught occurs, the flag will appear to droop naturally. That is the maximum point that the support rod can extend and still have the flag appear to be flying free. So long as that distance is long enough to prevent flag furl, then this setup is functional.

The point described in the preceding paragraph is defined by the angle (41). Where the angle (41) is 45 degrees, and the angle formed by the taught bottom edge of the flag and the flagstaff is always 90 degrees, then the angle formed by the vertical drop down line from point (43) and the flagstaff will always match the angle (41), in this case 45 degrees. Where the triangle formed by (42), (43) and (44) contains one angle of 90 degrees and one angle of 45 degrees, the third angle must also be 45 degrees, forming an isosceles triangle and the vertical line would thus intersect the bottom edge of the flag at 36 inches out from the inner edge. Thus, the flag, with top edge defined by points (43) and (45) would hang vertically and appear to fly freely in the absence of wind so long as the support rod were of maximum length of 36 inches. Note that as angle (41) increases or decreases, so too, does the calculation of vertical hang just described. As angle (41) decreases to approach zero, the support rod maximum length and maintain appearance of free flying also decreases. But, as described in the prior art, the problem of furl practically disappears when the angle (41) is zero, i.e., even if there is any furling, because the flagstaff is vertical, the flag then falls freely off of itself. At the opposite extreme, when the flagstaff is horizontal, and angle (41) equals 90 degrees, the flag hangs completely vertical ordinarily.

What remains is how much support rod length is required to prevent furl. Without any support rod, as noted, the flag pivot points are at points (42) and (43) and the entire length of the flag and complete surface area is free to wrap, and in the presence of wind, does so. However, with a support rod, the pivot points are now at points (43) and (44), with point (44) defined by the length of the support rod, and the surface area of the flag and length of flag fabric that is free to wrap is defined by points (43), (44) and (45).

Where point (44) is 20 inches out from the flagstaff, the length of material of the flag remaining, i.e., from point (44) to the edge of the flag is 40 inches. Thus, for this material to wrap and make it back to the flag staff and back around again, it takes 20 inches of the 40 inches of material to get back to the flagstaff and then only 20 inches remain. That remaining 20 inches is only long enough to get back to point (44), the starting point and there is nothing left to wrap around. thus, even in this 'perfect' wrapping scenario, the weight of the flag material that is wrapped over the flagstaff is equaled by the weight of the flag material that was prevented from wrapping and when the wind dies down, the weight of the flag material and force of gravity return the flag to an unwrapped state. In actual practice, it is rare that this 'perfect' wrapping situation even occurs because the flag generally does not get wrapped perfectly symmetrically and the point at (45) is generally the leading edge that comes into the flagstaff at an angle. In practice, an 18 or 19 inch rod support has proven effective with the use of a 3'×5' flag.

The present invention is further illustrated, but not limited by, the following examples.

EXAMPLES

In one embodiment, a typical existing 3'×5' flag and one inch flagstaff is mounted according normal practice. In one embodiment, a device manufactured according to the teachings herein is mounted to the flagstaff and secured with the set screw preventing the device from rotating about the flagstaff or moving along its length. The flag itself is then secured to the support rod along a portion of its bottom edge.

In the absence of wind, the flag hangs in a manner that appears to normal because the top edge of the flag is free to hang perfectly vertical as it would if the bottom edge had no support at all.

When there is wind, the flag begins to fly. In severe wind, the flag flies rapidly. In actuality, winds are not uniform, but rather swirl and send various points of the flag material in all sorts of directions. Without any support, the flag would be free to pivot at points (42) and (43) and would have the entire length of material to pivot around the flagstaff and itself. Other solutions to this problem all seem to include some sort of free rotation around the flagstaff at points (42) and (43). If the wind were always uniform and steady, this solution might be effective. But, it is only effective in theory because the wind in reality is not uniform and steady. When wind swirls, a portion of the flag may move in one direction and another portion may move in a different direction. When that happens, as is typical, rotating points at point (42) and (43) may rotate in opposite direction actually increasing wrapping and causing additional tangle of the flag.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

What is claimed is:

1. A device comprising:

a. mounting ring having an inside diameter, a thickness and a through hole;

b. a support rod having a length substantially shorter than the length of a flag with which said device is to be used and a means for securing that portion of a length of a bottom edge of said flag that corresponds to the length of the support rod along said portion and at said support rod's ends; and c. a securing set screw fitting through said hole of said mounting ring.

2. The device of claim 1 wherein said mounting ring and said support rod are constructed of one continuous material.

3. The device of claim 2 wherein said material is chosen from the group consisting of: stainless steel, aluminum, plastic, acrylic, wood, synthetic resin, synthetic wood, and fiberglass.

4. The device of claim 1 wherein said support rod further comprises a spring loaded clamping mechanism along its edge.

5. The device of claim 1 wherein said mounting ring and said support rod are constructed separately and further comprise a means for attachment.

* * * * *